US006630881B1

(12) United States Patent
Takeuchi et al.

(10) Patent No.: US 6,630,881 B1
(45) Date of Patent: Oct. 7, 2003

(54) METHOD FOR PRODUCING MULTI-LAYERED CHIP INDUCTOR

(75) Inventors: Hiroyuki Takeuchi, Shiga-ken (JP); Yoshiyuki Hatsuda, Kyotanabe (JP); Motoi Nishii, Omihachiman (JP); Yoshihiro Nishinaga, Hikone (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 68 days.

(21) Appl. No.: 09/618,787

(22) Filed: Jul. 18, 2000

Related U.S. Application Data

(62) Division of application No. 08/931,884, filed on Sep. 17, 1997, now Pat. No. 6,189,200.

(30) Foreign Application Priority Data

Sep. 17, 1996 (JP) ..... 8-245008

(51) Int. Cl.[7] ..... H01F 5/00
(52) U.S. Cl. ..... 336/200; 336/83; 336/232
(58) Field of Search ..... 336/83, 192, 200, 336/232, 208, 65; 29/602.1

(56) References Cited

U.S. PATENT DOCUMENTS

| | | | | |
|---|---|---|---|---|
| 3,812,442 A | * | 5/1974 | Muckelroy | 336/200 |
| 4,510,000 A | | 4/1985 | Kumar et al. | |
| 4,525,597 A | | 6/1985 | Abe | |
| 4,543,553 A | | 9/1985 | Mandai et al. | |
| 4,746,557 A | | 5/1988 | Sakamoto et al. | |
| 5,006,182 A | | 4/1991 | Gantzhorn, Jr. et al. | |
| 5,197,170 A | | 3/1993 | Senda et al. | |
| 5,379,004 A | | 1/1995 | Marusawa et al. | |
| 5,429,497 A | | 7/1995 | Yamada et al. | |
| 5,479,695 A | * | 1/1996 | Grader et al. | 336/200 |
| 5,505,809 A | | 4/1996 | Yamamoto et al. | |
| 5,532,667 A | * | 7/1996 | Haertling et al. | 336/200 |
| 5,700,338 A | | 12/1997 | Kubodera et al. | |
| 5,740,603 A | | 4/1998 | Kim | |

FOREIGN PATENT DOCUMENTS

| | | |
|---|---|---|
| JP | 12-287910 | 11/1989 |
| JP | 2-144906 | 6/1990 |
| JP | 493005 | 3/1992 |
| JP | 4-142714 | 5/1992 |
| JP | 6-69040 | 3/1994 |
| JP | 6-112047 | 4/1994 |
| JP | 8-18376 | 1/1996 |
| JP | 8-236354 | 9/1996 |

* cited by examiner

*Primary Examiner*—Elvin Enad
*Assistant Examiner*—Tuyen T. Nguyen
(74) *Attorney, Agent, or Firm*—Burns, Doane, Swecker & Mathis, LLP

(57) ABSTRACT

A method for producing a multi-layered chip inductor includes the steps of: forming coil-shaped internal conductors inside a green ceramic laminate, each of which coil-shaped internal conductors is spiralled around an axial line in the laminating direction of the green ceramic laminate; applying an external electrode paste onto at least one laminating-direction surface of the green ceramic laminate, which external electrode paste connects to an end of the coil-shaped internal conductor; cutting the green ceramic laminate along the laminating direction into chip-shaped-green ceramic laminates each having the coil-shaped internal conductor inside; and firing each of the chip-shaped green ceramic laminates and baking the external electrode paste to form an external electrode.

3 Claims, 9 Drawing Sheets

METHOD FOR PRODUCING MULTI-LAYERED CHIP INDUCTOR

This application is a divisional, of application Ser. No. 08/931,884, filed Sep. 17, 1997, now U.S. Pat. No. 6,189,200.

This application is based on Japanese Patent Application No. 8-245008, filed on Sep. 17, 1996, which is incorporated herein in its entirety by reference.

BACKGROUND OF THE INVENTION

1. Field of the Invention

The present invention relates to a method for producing multi-layered chip inductors, in which a large number of external electrodes can be readily formed.

2. Description of the Related Art

A conventional method for producing chip inductors will be explained with reference to FIGS. 10 to 12.

First, a slurry of a magnetic ceramic material is applied to the surface of a base film, dried, and then stripped from the base film to obtain a magnetic green sheet (not shown in the figures). In the ceramic arts, the term "green" generally refers to a ceramic part in its unsintered state, as explained on pages 181–185 of Engineering Materials Handbook: Ceramics and Glasses, Vol. 4, 1991, ASM International. Green sheet pieces 1*b* having a predetermined size are then prepared by cutting the magnetic green sheet. A via hole 2 is made at a predetermined position on each of the green sheet pieces 1*b*. A coil-shaped internal conductor pattern 3 is printed, for example, using a paste essentially consisting of Ag, at a predetermined position on each of the green sheet pieces 1*b*. A predetermined number of the green sheet pieces 1*b* are laminated to form a coil spiralled in the laminating direction, as is shown in FIG. 10. Electrical continuity between the printed coil-shaped internal conductor patterns 3 of the green sheet pieces 1*b* is achieved through the via holes 2, as is shown by the dotted lines in FIG. 10. A predetermined number of green sheet pieces 1*a* on which no conductor pattern is printed are provided above and below the laminated green sheet pieces 1*b* and are pressed to adhere to one another and to adhere to the green sheet pieces 1*b*.

In a practical manufacturing process, large-area green sheet pieces having a plurality of coil-shaped internal conductors are used for preparing a green ceramic laminate 4 comprising a group of chip-shaped laminates, shown in FIG. 11. The green ceramic laminate 4 is cut along the dotted lines 5 and 6 to obtain chip-shaped green ceramic laminates 7 having a structure shown in FIG. 12. Each end 3*a* of the coil-shaped internal conductors 103 formed inside the chip-shaped green ceramic laminates 7 is exposed on the corresponding cut face.

Each of the chip-shaped green ceramic laminates 7 is then fired. To obtain a multi-layered chip inductor, external-electrode-paste layers 8 are formed on the cut faces, which are parallel to the lamination direction of the fired chip-shaped ceramic laminate 7 so that the external-electrode-paste layers 8 electrically connect to the corresponding ends 3*a* of the coil-shaped internal conductor 103, as is shown in FIG. 12.

However, according to the above structure, the ends 3*a* of the coil-shaped internal conductor 103 are located inside the green ceramic laminate 4, i.e., exposed on the cut faces of each chip-shaped laminate 7. Therefore, for producing a multi-layered chip inductor having the above structure, the following procedure is required: the green ceramic laminate 4 is cut into chip-shaped laminates 7 so that each end 3*a* of coil-shaped internal conductors 103 is exposed on a cut face; and the external-electrode-paste layers 8 are formed on the cut faces having the exposed ends 3*a* at chip-shaped laminates 7.

Thus, disadvantageously, a jig, an extra manufacturing step, and longer processing time are required for forming the external-electrode-paste layers 8 on the corresponding cut faces of each chip-shaped laminate 7.

SUMMARY OF THE INVENTION

To solve the above problems, the present invention is aimed at providing a method for producing a multi-layered chip inductor, in which a large number of external electrodes can be readily formed by applying an external electrode paste to the laminating-direction surfaces of a ceramic laminate that has not yet been cut into chip-shaped laminates. In the following discussion, the term "laminating-direction surface" pertains to a direction parallel to the surfaces of the laminated sheets. The term "laminating direction" pertains to a direction generally perpendicular to the surface of the laminated sheets, which also generally corresponds to the longitudinal axis of an inductor coil within the multi-layered chip inductor.

According to the present invention, a method for producing a multi-layered chip inductor comprises: a step for forming coil-shaped internal conductors inside a green ceramic laminate, each of which coil-shaped internal conductors is spiralled around an axial line in the laminating direction of the green ceramic laminate; a step for applying an external electrode paste onto at least one laminating-direction surface of the green ceramic laminate, which external electrode paste electrically connects to an end of the coil-shaped internal conductors; a step for cutting the green ceramic laminate along the laminating direction into chip-shaped green ceramic laminates each having a coil-shaped internal conductor inside; and a step for firing each of the chip-shaped green ceramic laminates and baking the external electrode paste to form an external electrode.

In addition, another method for producing a multi-layered chip inductor comprises: a step for forming coil-shaped internal conductors inside a green ceramic laminate, each of which coil-shaped internal conductors is spiralled around an axial line in the laminating direction of the green ceramic laminate; a step for applying an external electrode paste onto at least one laminating-direction surface of the green ceramic laminate, which external electrode paste electrically connects to an end of the coil-shaped internal conductors; a step for firing the green ceramic laminate and baking the external electrode paste to form an external electrode; and a step for cutting the fired ceramic laminate along the laminating direction into chip-shaped ceramic laminates each having a coil-shaped internal conductor inside.

Still another method for producing a multi-layered chip inductor comprises: a step for forming coil-shaped internal conductors inside a green ceramic laminate, each of which coil-shaped internal conductors is spiralled around an axial line in the laminating direction of the green ceramic laminate; a step for firing the green ceramic laminate; a step for applying and baking an external electrode paste electrically connected to an end of the coil-shaped internal conductors onto at least one laminating-direction surface of the fired ceramic laminate so as to form an external electrode; and a step for cutting the fired ceramic laminate, on which the external electrode paste has been baked to form an external electrode, along the laminating direction into chip-shaped ceramic laminates each having a coil-shaped internal conductor inside.

Furthermore, for each chip inductor, both ends of the coil-shaped internal conductor are led to one laminating-direction surface of the multi-layered chip inductor and two baked external electrodes are formed on this laminating-direction surface so that the electrodes are electrically connected to the corresponding ends. Preferably, a plating layer is formed on the surface of the baked external electrode.

Another method for producing a multi-layered chip inductor comprises: a step for forming coil-shaped internal conductors inside a green ceramic laminate, each of which coil-shaped internal conductors is spiralled around an axial line in the laminating direction of the green ceramic laminate; a step for firing the green ceramic laminate and forming an external thin-film electrode on at least one laminating-direction surface of the fired ceramic laminate, which external thin-film electrode electrically connects to an end of the coil-shaped internal conductors; and a step for cutting the fired ceramic laminate along the laminating direction into chip-shaped ceramic laminates each having a coil-shaped internal conductor inside.

Both ends of the coil-shaped internal conductor are led to one laminating-direction surface of the multi-layered chip inductor and two baked external thin-film electrodes are formed on this one laminating-direction surface so that the electrodes are electrically connected to the corresponding ends of the coil-shaped internal conductor. Preferably, a plating layer is formed on the surface of said external thin-film electrodes.

According to the above methods, external electrodes can be provided on a laminating-direction surface of a ceramic laminate (i.e., a group of chip-shaped laminates) which has not yet been divided into chip-shaped laminates.

The invention also pertains to multi-layered chip inductors produced by the aforementioned methods.

BRIEF DESCRIPTION OF THE DRAWINGS

The foregoing and other, objects, features and advantages of the present invention will be more readily understood upon reading the following detailed description in conjunction with the drawings in which.

DESCRIPTION OF THE PREFERRED EMBODIMENTS

Figure 1:
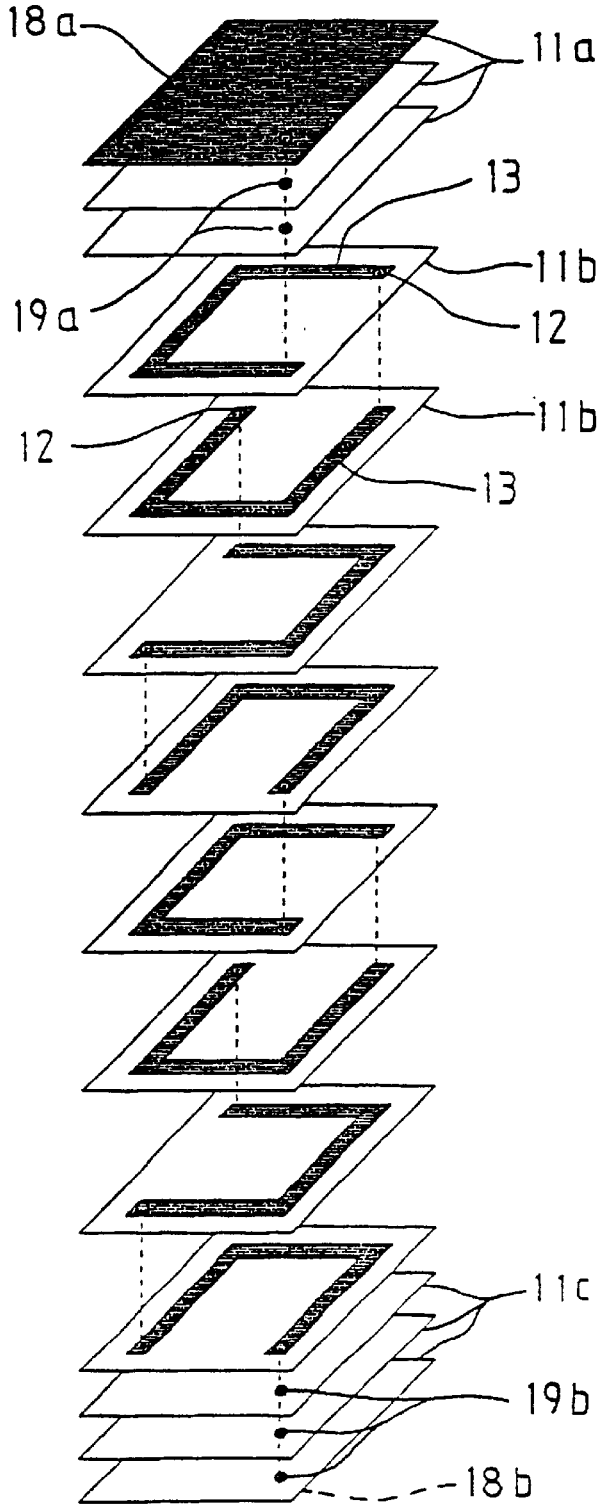
FIG. 1 is a perspective view of green sheet pieces and external-electrode-paste layers composing a multi-layered chip inductor produced by a method of an exemplary embodiment of the present invention.

A method for producing multi-layered chip inductors of a first exemplary embodiment of the present invention will be explained in detail with reference to FIGS. 1 to 3.

A via hole 12 is made at a predetermined position on each of the insulating green sheet pieces 11*b* made of a magnetic ceramic material or the like. A coil-shaped internal conductor pattern 13 is then printed at a predetermined position on each of the insulating green sheet pieces 11*b*. A predetermined number of the resulting green sheet pieces 11*b* are laminated, as is shown in FIG. 1. A coil-shaped internal conductor spiralled around an axial line along the laminating direction is thereby formed inside the resulting green ceramic laminate. Furthermore, a predetermined number of green sheet pieces 11*a* and 11*c* are laminated respectively above and below the green sheet pieces 11*b* forming the coil-shaped internal conductor and are pressed to adhere to one another and to adhere to the laminated sheet pieces 11*b*. The green sheet pieces 11*a* and 11*c* have via holes 19*a* and 19*b*, respectively, to achieve conductive continuity with the corresponding ends of the coil-shaped internal conductor. An external electrode paste is then applied to the entire surface of the upper-most green sheet piece 11*a* and the lower-most green sheet piece 11*c* to form external-electrode-paste layers 18*a* and 18*b*, respectively.

Figure 2:
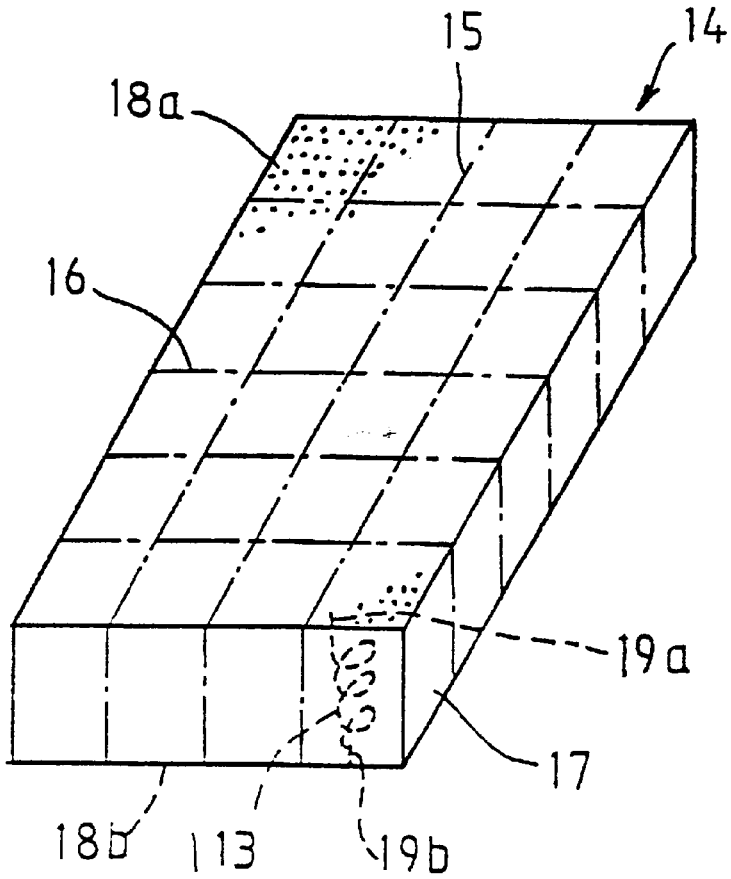
FIG. 2 is a perspective view of a green ceramic laminate to be cut to produce a multi-layered chip inductor having the structure shown in FIG. 1.
Figure 3:
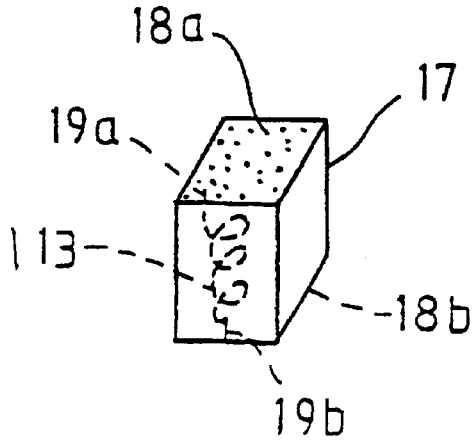
FIG. 3 is a perspective view of a chip-shaped laminate obtained by cutting the green ceramic laminate shown in FIG. 2.

In a practical manufacturing process, a large-area green ceramic laminate 14 (i.e., comprising a group of chip-shaped laminates 17) including a plurality of coil-shaped internal conductors each spiralled along the laminating direction is prepared, as is shown in FIG. 2. The green ceramic laminate 14 is cut into the chip-shaped laminates 17 along the laminating direction according to the cutting lines 15 and 16. As is shown in FIG. 3, both laminating-direction surfaces (i.e., the upper-most layer and the lower-most layer in the laminating direction) of each chip-shaped laminate 17 have the external-electrode-paste layers 18*a* and 18*b* disposed thereon, respectively, which layers 18*a* and 18*b* have conductive continuity with the corresponding ends of the coil-shaped internal conductor 113 through the via holes 19*a* and 19*b*.

To obtain multi-layered chip inductors, the resulting chip-shaped laminates 17 are then subjected to firing while simultaneously baking the external-electrode-paste layers 18*a* and 18*b*.

In addition, a plating film, such as a two-layer plating film having a lower Ni layer and an upper layer made of tin or solder, or other conductive material, is preferably formed on the surface of the thus-baked external-electrode-paste layers 18*a* and 18*b* so as to improve solderability with respect to wiring of circuit substrates, etc. and heat resistance of soldering.

According to the above embodiment, the green ceramic laminate 14 are first cut into the chip-shaped laminates 17 and then fired. However, the fired chip-shaped laminates 17 may be obtained as follows: a fired ceramic laminate is prepared by firing the green ceramic laminate 14 while simultaneously baking the external-electrode-paste layers 18*a* and 18*b*, and then the laminate 14 is cut into the chip-shaped laminates 17 along the laminating direction.

Figure 4:
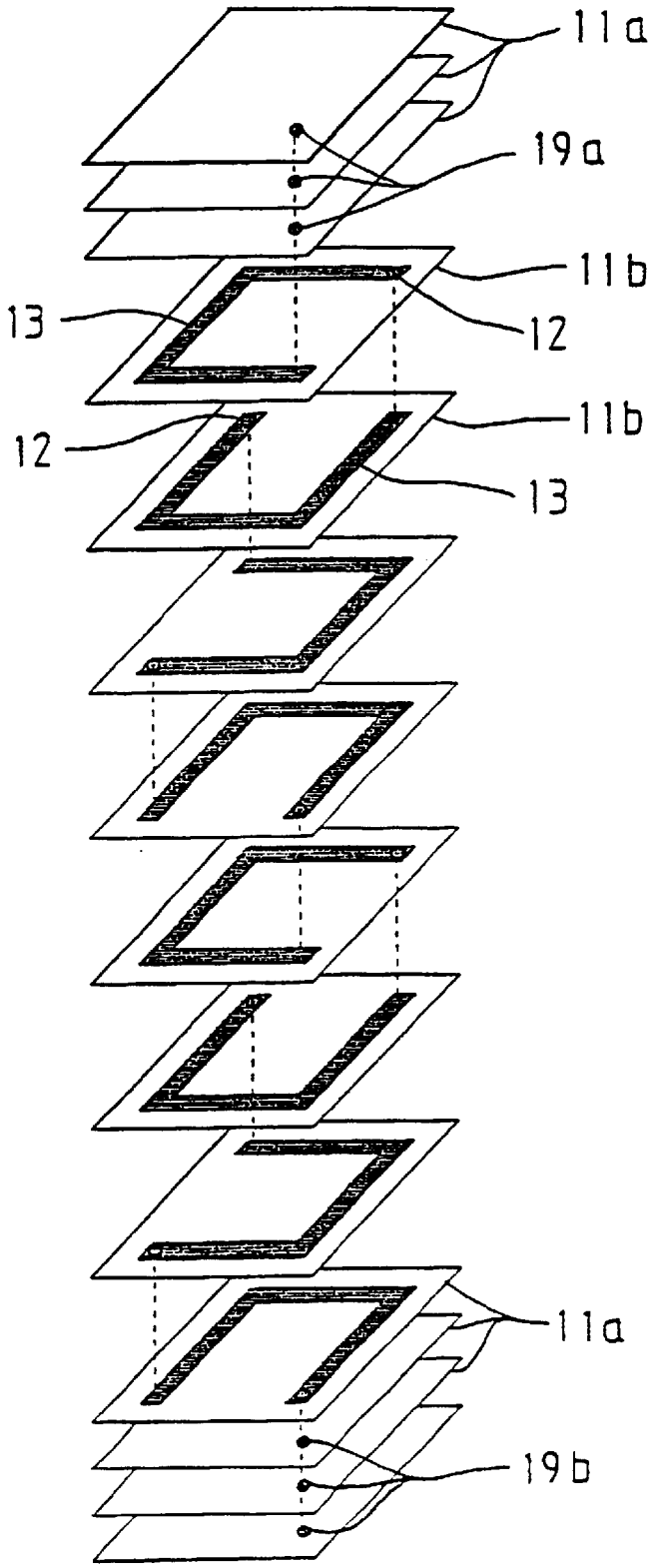
FIG. 4 is a perspective view of green sheet pieces and external-electrode-paste layers composing a multi-layered chip inductor produced by a method of another exemplary embodiment of the present invention.
Figure 5:
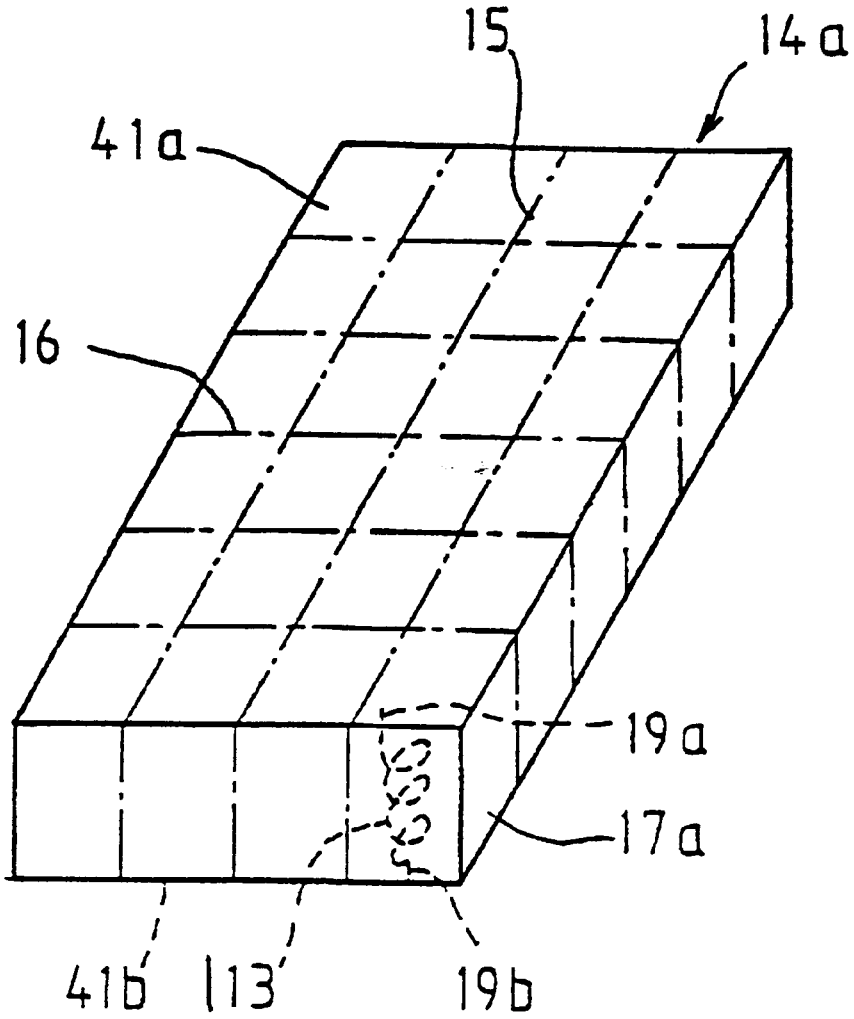
FIG. 5 is a perspective view of a green ceramic laminate to be cut to produce a multi-layered chip inductor having the structure shown in FIG. 4.
Figure 6A:
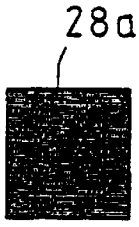
FIGS. 6(*a*) to 6(*m*) illustrate a printing process of a multi-layered chip inductor produced by a method of another exemplary embodiment of the present invention.
Figure 6B:
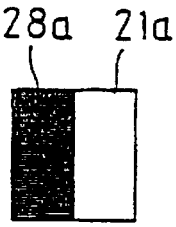
Figure 6C:
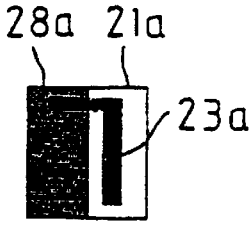
Figure 6D:
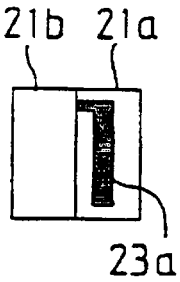
Figure 6E:
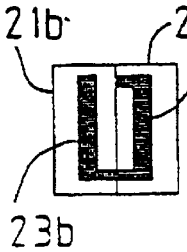
Figure 6F:
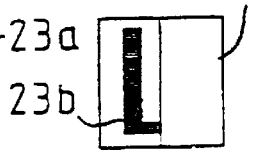
Figure 6G:
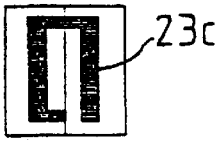
Figure 6H:
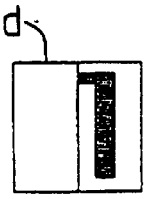
Figure 6I:
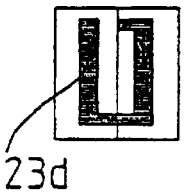
Figure 6J:
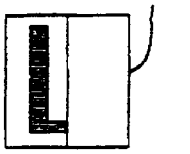
Figure 6K:
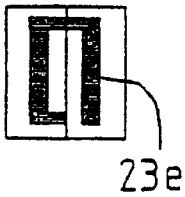
Figure 6L:
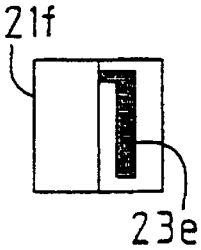
Figure 6M:
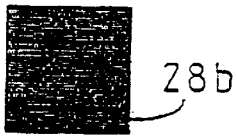

A method for producing multi-layered chip inductors of another exemplary embodiment of the present invention will be described in detail with reference to FIGS. 4 and 5. The numerals in the different views identify substantially identical parts as in the above embodiment, and detailed explanations thereof are omitted.

A predetermined number of green sheet pieces 11*b* are laminated. A predetermined number of green sheet pieces 11*a* are laminated on both the upper and lower layers of the laminated green sheet pieces 11*b* and are pressed to adhere to each other and to adhere to the laminated sheet pieces 11*b*, as is shown in FIG. 4. Consequently, a green ceramic laminate 14*a*, that is, a group of chip-shaped laminates 17*a* each having a coil-shaped internal conductor 113 inside, can be prepared, as is shown in FIG. 5. An external electrode paste has not yet been applied onto the laminating-direction surfaces of the green ceramic laminate 14*a*.

After firing the green ceramic laminate 14*a*, an external electrode paste (not shown in the Figure) providing electrical connection to the via holes 19*a* and 19*b* is applied onto the upper laminating-direction surface 41*a* and the lower laminating-direction surface 41*b* of the fired laminate, followed by baking. In a practical manufacturing process, a large-area fired ceramic laminate 14*a* which includes a plurality of coil-shaped internal conductors 113 each spiralled along the laminating direction, and which has baked external-electrode-paste layers, is prepared, as is shown in FIG. 5. The fired ceramic laminate 14*a* is then cut into chip-shaped laminates 17*a* along the laminating direction according to the cutting lines 15 and 16.

In addition, as is similar to the foregoing embodiment, a plating film, such as a two-layer plating film having a lower Ni layer and an upper layer made of tin or solder, or other conductive material, is preferably formed on the surface of the baked external-electrode-paste layers.

A method for producing multi-layered chip inductors of another exemplary embodiment of the present invention will be described in detail with reference to FIGS. 6(*a*) to 6(*m*).

First, as is shown in FIG. 6(*a*), an external-electrode-paste layer 28*a* is printed on a base film (not shown in the figure), for example, using a paste essentially consisting of Ag, or other conductive material. A magnetic-paste layer 21*a* is then printed on substantially the right-half area of the external-electrode-paste layer 28*a*, as is shown in FIG. 6(*b*). An internal conductor pattern 23*a* is then printed on the magnetic-paste layer 21*a* such that the internal conductor pattern 23*a* is electrically connected to the external-electrode-paste layer 28*a*, as is shown in FIG. 6(*c*). As is shown in FIG. 6(*d*), a magnetic-paste layer 21*b* is then printed on substantially the entire exposed surface of the external-electrode-paste layer 28*a* shown in FIG. 6(*c*). An internal conductor pattern 23*b* is then printed on the magnetic-paste layer 21*b* such that the internal conductor pattern 23*b* is electrically connected to the internal conductor pattern 23*a*, as is shown in FIG. 6(*e*). According to the same manner, magnetic-paste layers 21*c* to 21*f* and internal conductor patterns 23*c* to 23*e* are printed, as is shown in FIGS. 6(*f*) to 6(*l*). An external electrode paste layer 28*b* is then printed on the entire surface so that it electrically connects to the internal conductor pattern 23*e*, as is shown in FIG. 6(*m*). According to the above procedure, a green ceramic laminate (not shown in the Figures), that is, a group of chip-shaped laminates each having a coil-shaped internal conductor spiralled along the laminating direction, can be obtained similar to one of the foregoing embodiments.

The resulting green ceramic laminate is cut into chip-shaped green ceramic laminates along the laminating direction. The chip-shaped green ceramic laminates are then subjected to firing while simultaneously baking the external-electrode-paste layers 28*a* and 28*b*.

In addition, as is similar to the foregoing embodiments, a plating film, such as a two-layer plating film having a lower Ni layer and an upper layer made of tin or solder, or some other conductive material, is preferably formed on the surface of the baked external-electrode-paste layers 28*a* and 28*b*.

Although numerous magnetic-paste layers 21 and internal conductor patterns 23 are printed on the base film to form numerous coil-shaped internal conductors at the same time, to facilitate explanation, FIG. 6 shows only one coil-shaped internal conductor formed in one divided chip-shaped laminate.

A method for producing multi-layered chip inductors of still another exemplary embodiment of the present invention will be described in detail with reference to FIGS. 7 and 9. The numerals in the different views identify substantially identical parts as in the above embodiments, and detailed explanations thereof are omitted.

Via holes 12 and 39*b* are made at predetermined respective positions on each green sheet piece 31*b*. A coil-shaped internal conductor pattern 33 is then printed at a predetermined position on each green sheet piece 31*b*. A predetermined number of the resulting green sheet pieces 31*b* are laminated, as is shown in FIG. 7. A predetermined number of green sheet pieces 31*a* each having via holes 39*a* and 39*b* and a predetermined number of green sheet pieces 31*a* are further provided respectively above and below the laminated green sheet pieces 31*b* and are pressed to adhere to each other and to the sheet pieces 31*b*. Two strip-shaped external-electrode-paste layers 38*a* and 38*b* are then provided on the surface of the upper-most green sheet piece 31*a* so as to achieve conductive continuity with the corresponding ends of the thus-formed coil-shaped internal conductor 133.

Figure 8:
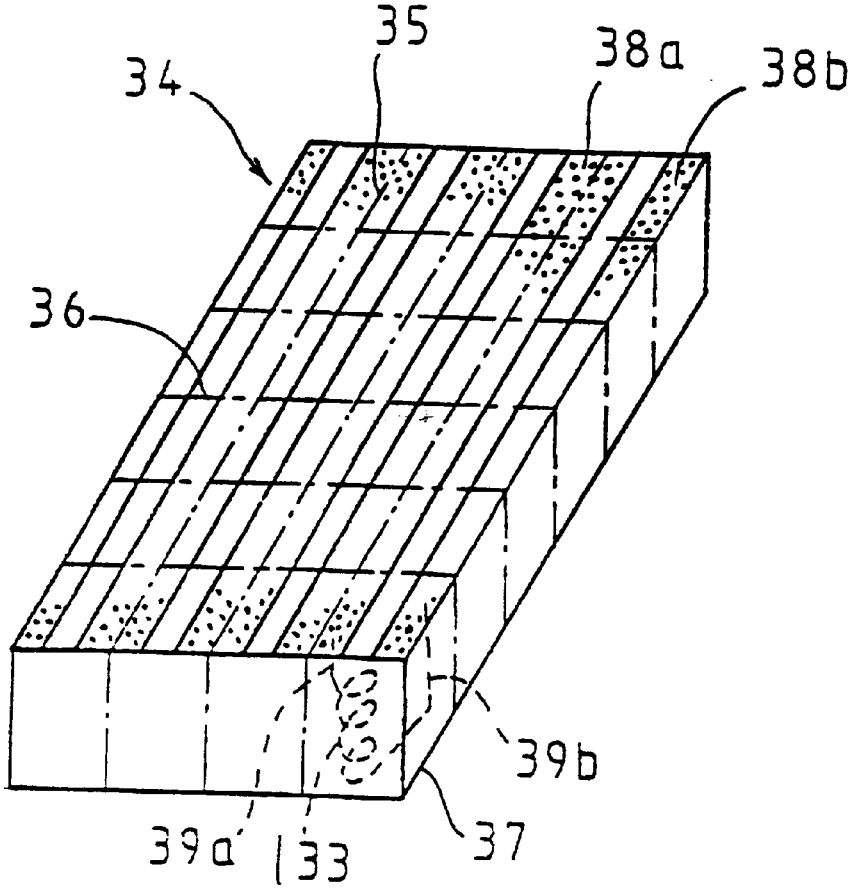
FIG. 8 is a perspective view of a green ceramic laminate to be cut to produce a multi-layered chip inductor having the structure shown in FIG. 7.

In a practical manufacturing process, a large-area green ceramic laminate 34 including a plurality of coil-shaped internal conductors 133 each spiralled along the laminating direction, as is shown in FIG. 8, is cut into chip-shaped laminates 37 along the cutting lines 35 and 36.

Figure 9:
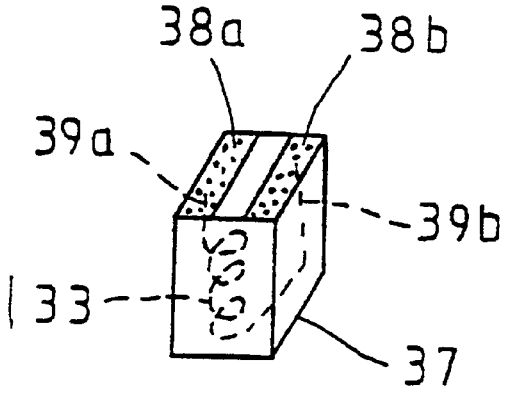
FIG. 9 is a perspective view of a chip-shaped laminate obtained by cutting the green ceramic laminate shown in FIG. 8.
Figure 10:
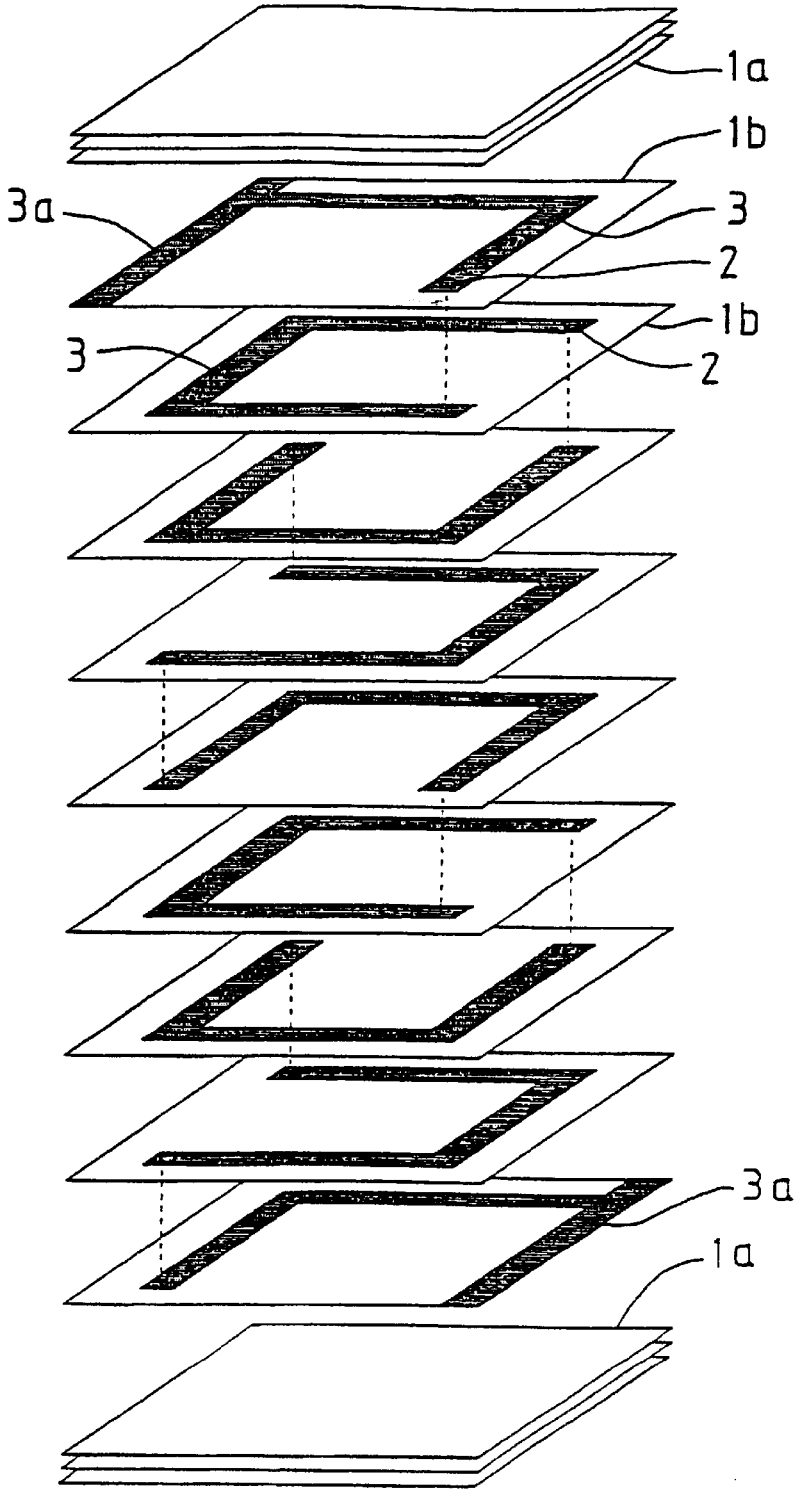
FIG. 10 (PRIOR ART)
FIG. 10 is a perspective view of green sheet pieces composing a multi-layered chip inductor produced by a conventional method.
Figure 11:
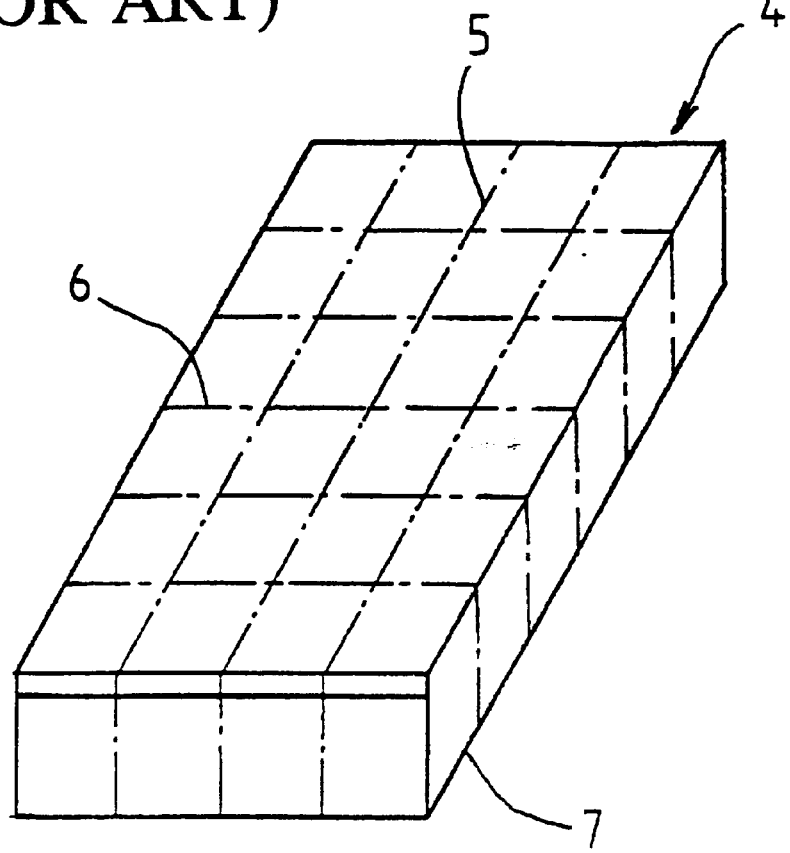
FIG. 11 (PRIOR ART)
FIG. 11 is a perspective view of a green ceramic laminate to be cut to produce a multi-layered chip inductor having the structure shown in FIG. 10.
Figure 12:
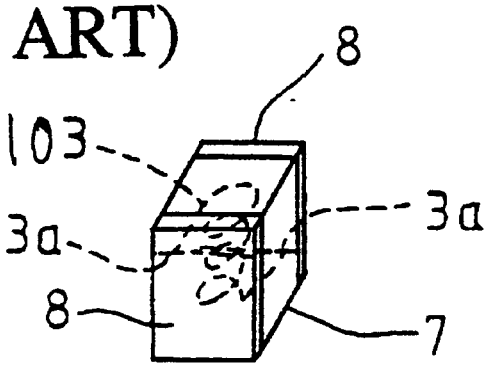
FIG. 12 (PRIOR ART)
FIG. 12 is a perspective view of a chip-shaped laminate obtained by cutting the green ceramic laminate shown in FIG. 10.

As is shown in FIG. 9, one laminating-direction surface of each chip-shaped laminate 37 has both the external-electrode-paste layer 38*a* and 38*b* having conductive continuity with the corresponding ends of the coil-shaped internal conductor 133 through the corresponding via holes 39*a* and 39*b*.

To obtain multi-layered chip inductors, the resulting chip-shaped laminates 37 are then subjected to firing while simultaneously baking the external-electrode-paste layers 38*a* and 38*b* .

In addition, a plating film, such as a two-layer plating film having a lower Ni layer and an upper layer made of tin or solder, or other conductive material, is preferably formed on the surface of the thus-baked external-electrode-paste layers 38*a* and 38*b*, as is similar to the foregoing embodiments.

Figure 7:
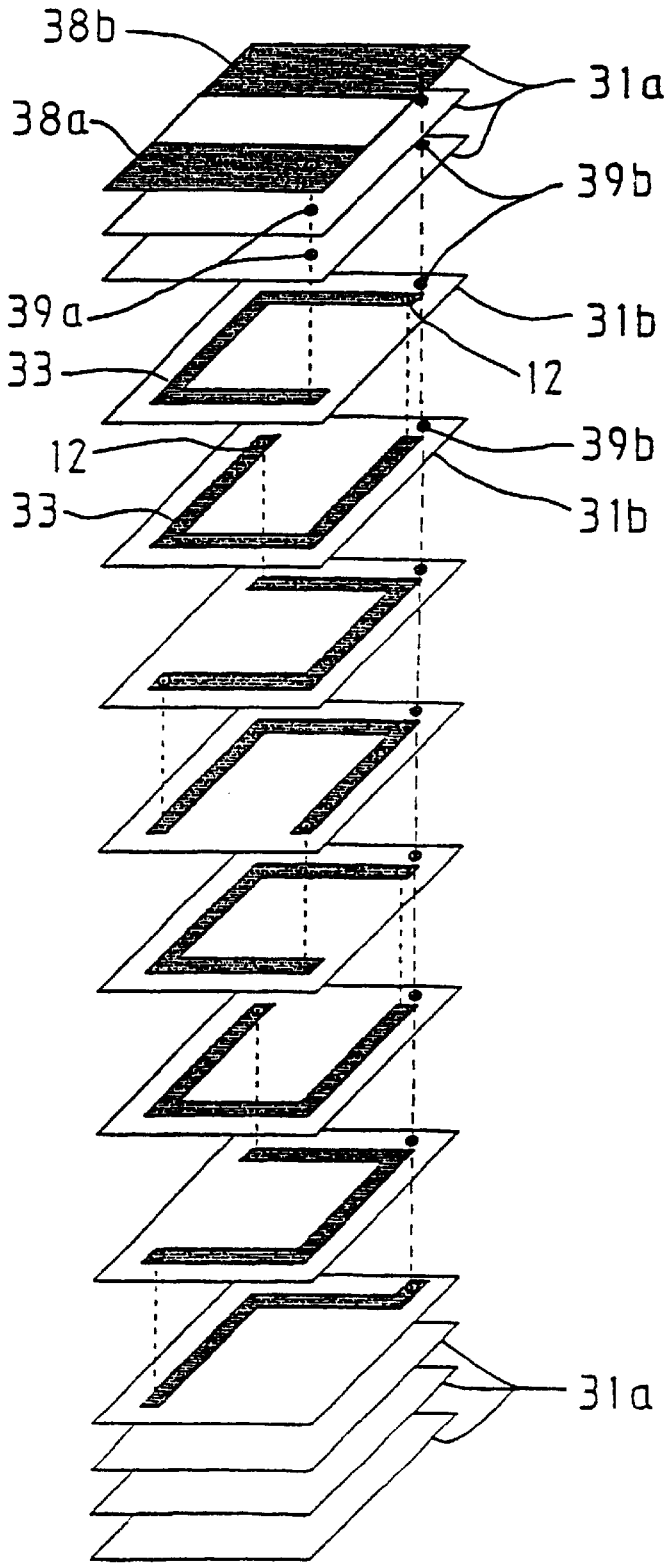
FIG. 7 is a perspective view of green sheet pieces and external-electrode-paste layers composing a multi-layered chip inductor produced by a method of still another exemplary embodiment of the present invention.

Although numerous internal conductor patterns 33 are simultaneously printed on each green sheet piece 31*b* to form numerous coil-shaped internal conductors, FIG. 7 shows one coil-shaped internal conductor formed in one chip-shaped laminate 37 to facilitate explanation.

According to the above embodiments shown in FIGS. 6 to 9, chip-shaped laminates prepared by cutting a green ceramic laminate are fired while simultaneously baking external-electrode-paste layers. However, fired chip-shaped laminates may be obtained by cutting a fired ceramic laminate along the laminating direction, which fired ceramic laminate is prepared by firing a green ceramic laminate while simultaneously baking external-electrode-paste layers or by firing the green ceramic laminate and then applying and baking the external-electrode-paste layers.

According to the foregoing embodiments shown in FIGS. 1 to 9, an external electrode paste is applied onto a green ceramic laminate in the process of manufacturing multi-layered chip inductors. However, multi-layered chip inductors may be produced as follows: a green ceramic laminate not having the external electrode paste thereon is fired; external thin-film electrodes electrically connected to the corresponding ends of a coil-shaped internal conductor are formed on at least one laminating-direction surface of the fired ceramic laminate, for example, by deposition, sputtering or other technique; and then the fired ceramic laminate is cut into chip-shaped laminates along the laminating direction. In this case, the external thin-film electrodes are composed of, for example, a lower Ni alloy layer and an upper Ag layer, or other conductive material.

As above-described, according to a method of producing a multi-layered chip inductor of the present invention, both ends of a coil-shaped internal conductor spiralled around the axial line in the laminating-direction are exposed on a laminating-direction surface through corresponding via holes. Therefore, the coil-shaped internal conductor inside the green ceramic laminate, which has not been cut into chip-shaped laminates yet, can achieve electrical continuity with an external electrode paste applied onto the laminating-direction surface. In other words, the external electrode paste layers can be formed on numerous chip-shaped laminates at the same time.

In addition, according to a method of the present invention, a ceramic laminate is cut into chip-shaped laminates after being provided with an external electrode paste and baked. Therefore, the manufacturing process becomes simpler and more suitable to mass production as compared with the conventional methods in which chip-shaped laminates are cut from a green ceramic laminate, fired, and then provided with an external electrode paste, followed by baking the paste.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A multi-layered chip inductor comprising:

a coil-shaped internal conductor inside a ceramic laminate, said coil-shaped internal conductor being spiralled around an axial line in a laminating direction of said ceramic laminate, wherein said coil-shaped internal conductor is formed by a plurality of internal conductor patterns laminated on a plurality of ceramic laminate pieces, the ceramic laminate pieces and the internal conductor patterns being laminated on top of one another in the laminating direction to form a ceramic laminate having two laminating direction surfaces, the plurality of internal conductor patterns being connected through via holes in the ceramic laminate pieces; and external electrodes disposed on an entirety of both laminating-direction surfaces of said ceramic laminate, said external electrodes being electrically connected to respective ends of said coil-shaped internal conductor, wherein peripheral shapes of the external electrodes are identical to peripheral shapes of said laminating-direction surfaces.

2. The multi-layered chip inductor of claim 1, wherein said external electrodes being electrically connected respectively to both ends of said coil-shaped internal conductor via said two opposing laminating-direction surfaces.

3. The multi-layered chip inductor of claim 1, wherein the external electrode is a fired electrode paste.

* * * * *